US011311996B2

(12) United States Patent
Gardikis et al.

(10) Patent No.: US 11,311,996 B2
(45) Date of Patent: Apr. 26, 2022

(54) SELF-HAMMERING, COPPER-BONDED STEEL GROUND ROD TOOL FOR LOCATING UNDERGROUND UTILITIES

(71) Applicants: Daniel Robert Gardikis, Westport, MA (US); Aaron Pereira, Westport, MA (US)

(72) Inventors: Daniel Robert Gardikis, Westport, MA (US); Aaron Pereira, Westport, MA (US)

(73) Assignee: Pine Hill Farm, LLC, Westport, MA (US)

( * ) Notice: Subject to any disclaimer, the term of this patent is extended or adjusted under 35 U.S.C. 154(b) by 0 days.

(21) Appl. No.: 16/948,083

(22) Filed: Sep. 2, 2020

(65) Prior Publication Data

US 2022/0063077 A1 Mar. 3, 2022

(51) Int. Cl.

| | |
|---|---|
| ***H01R 4/00*** | (2006.01) |
| ***B25D 1/16*** | (2006.01) |
| ***H01R 4/66*** | (2006.01) |

(52) U.S. Cl.

CPC ..... *B25D 1/16* (2013.01); *H01R 4/66* (2013.01)

(58) Field of Classification Search

CPC ..... B25D 1/16; H01R 4/66

See application file for complete search history.

(56) References Cited

U.S. PATENT DOCUMENTS

| | | | | |
|---|---|---|---|---|
| 2,033,227 A | | 3/1936 | Brown | |
| 2,629,985 A | | 3/1953 | Mcdowell | |
| 2,693,086 A | | 11/1954 | Caruthers et al. | |
| 3,268,853 A | * | 8/1966 | Noker | H01R 11/15 439/791 |
| 3,716,649 A | * | 2/1973 | Smith | H01R 4/66 174/7 |
| 4,315,551 A | * | 2/1982 | Iannone | H01R 4/66 173/128 |
| 4,557,409 A | | 12/1985 | Hecock et al. | |
| D284,930 S | | 8/1986 | Richards | |
| 4,858,704 A | | 8/1989 | McDonald et al. | |
| 4,955,439 A | | 9/1990 | Kinnan | |
| 5,029,427 A | | 7/1991 | Jewett | |
| 5,086,849 A | | 2/1992 | Dahl | |
| 5,337,836 A | | 8/1994 | Williams | |
| 5,462,126 A | * | 10/1995 | Wallace | E02D 7/04 173/90 |
| 5,542,479 A | | 8/1996 | Stachler et al. | |
| D428,389 S | | 7/2000 | Love | |
| 6,148,929 A | | 11/2000 | Winters | |
| 6,364,031 B1 | | 4/2002 | Amicangelo | |
| 7,568,306 B1 | | 8/2009 | Rice, Sr. | |
| 7,798,384 B2 | | 9/2010 | Paske | |

(Continued)

FOREIGN PATENT DOCUMENTS

| | | | | |
|---|---|---|---|---|
| WO | WO-2018071003 A1 * | 4/2018 | ..... | E21B 7/00 |

*Primary Examiner* — Pete T Lee

(74) *Attorney, Agent, or Firm* — Dunlap Bennett & Ludwig, PLLC

(57) ABSTRACT

A unitary tool that combines a ground rod to a self-hammering mechanism in a trapped configuration. The ground rod has a length ranging between forty-two and fifty-two inches for facilitating the self-hammering functionality. The ground rod is made from copper-bonded steel for more effectively grounding an electrical connection than the prior art.

7 Claims, 4 Drawing Sheets

(56) References Cited

U.S. PATENT DOCUMENTS

| | | | | |
|---|---|---|---|---|
| 9,453,321 | B2 | 9/2016 | Hartman | |
| 2003/0070821 | A1 | 4/2003 | McPhillips | |
| 2004/0154814 | A1* | 8/2004 | Brennan | H01R 4/66 174/6 |
| 2005/0145286 | A1* | 7/2005 | Rivers | H01R 4/66 138/96 R |
| 2008/0257113 | A1* | 10/2008 | Neumarkel | B25D 1/16 81/27 |
| 2019/0040690 | A1 | 2/2019 | Kent | |
| 2020/0248840 | A1 | 8/2020 | Pipkin et al. | |

* cited by examiner

SELF-HAMMERING, COPPER-BONDED STEEL GROUND ROD TOOL FOR LOCATING UNDERGROUND UTILITIES

BACKGROUND OF THE INVENTION

The present invention relates to grounding rods and, more particularly, a self-hammering, copper-bonded steel ground rod tool for locating underground utilities.

Ground rods used in the location of underground utilities face at least two challenges: one, driving the ground rod in the ground; and two, the driven-rod providing a suitable electrical ground to facilitate the operation of an electrically connected transmitter used to detect underground utility equipment (relative to the electrical ground).

First, hammering current rod into the ground with a separate hammer requires the user to eventually get uncomfortably low to the ground during the probe-driving process, and such a low, vulnerable position increases the risk of an accidental injury to fingers. Additionally, the user is required to keep a hammer handy at all times.

Second, for electrical measurements generally, and specifically for locating underground utility equipment, the ground rod's physical connection to Earth serves as a (reasonably) constant potential reference against which other potentials (e.g., underground utility equipment and associated signals) can be measured.

Current ground rods are short relative to the user and the task at hand, which makes it harder for the user to get a good ground and to physically get the rod into the ground, as well as making it hard to see the ground rod once driven in the ground, making them a tripping hazard. Also, current ground rods are made of steel, which does not provide the best ground.

As can be seen, there is a need for a self-hammering, copper-bonded steel ground rod tool for locating underground utilities. If the rod can go deeper into the ground one can get a better reading, so the length of the rod makes a difference. Steel does not provide the most accurate ground. Accordingly, the present invention embodies a copper-bonded steel ground rod having a substantially greater length than the prior art.

The taller height of the present invention also provides for less bending down on the part of the user as well as going deeper into the ground. The present invention is self-hammering so there are no other tools necessary to get the ground rod into the ground safely, and additionally there is less risk of injury while hammering. Furthermore, the unitary construction of the present invention permanently traps the copper-bonded steel ground rod into the slide hammer, thereby the unitary tool is able to put itself in and out of the ground using the slide hammer, and by doing so is specifically designed in a way that a user cannot hurt their fingers while using the hammering mechanism. The present invention is also painted safety blue so it is very visible.

The present invention is made of copper-bonded steel, which provides a more accurate ground, eliminating many of the application problems that occur when locating underground utilities, which typically can be traced to a poor electrical ground. The UL-listed copper-bonded steel also provides a better electrical connection when operatively associating the required transmitter by way of an intermediate clamp or other connector.

SUMMARY OF THE INVENTION

In one aspect of the present invention, a unitary tool operatively associating a self-hammering mechanism to a ground rod in a trapped configuration includes the following: the ground rod extending between a proximal portion to a pointed tip; the ground rod comprising a copper portion; and the self-hammering mechanism including the following: a hammering sleeve slidably associated with the proximal portion; and an annular plug connected to a distal end of the hammering sleeve preventing the proximal portion from slidably disassociating with the hammering sleeve.

In another aspect of the present invention, the unitary tool operatively associating a self-hammering mechanism to a ground rod in a trapped configuration includes the following: the ground rod extending between a proximal portion to a pointed tip for a longitudinal length between forty-two and fifty-two inches; the ground rod comprising copper-bonded metal; the self-hammering mechanism includes the following: a hammering sleeve slidably associated with the proximal portion; an annular plug connected to a distal end of the hammering sleeve preventing the proximal portion from slidably disassociating with the hammering sleeve; and a solid plug connected along a proximal end of the hammering sleeve; one or more stops connected to the proximal portion, the one or more stops has a stop diameter exceeding a hole diameter of the annular plug, wherein the proximal portion is in the trapped configuration; and a clamp electrically connected to said copper-bonded steel outside of the hammering sleeve.

These and other features, aspects and advantages of the present invention will become better understood with reference to the following drawings, description and claims.

DETAILED DESCRIPTION OF THE INVENTION

Figure 1:
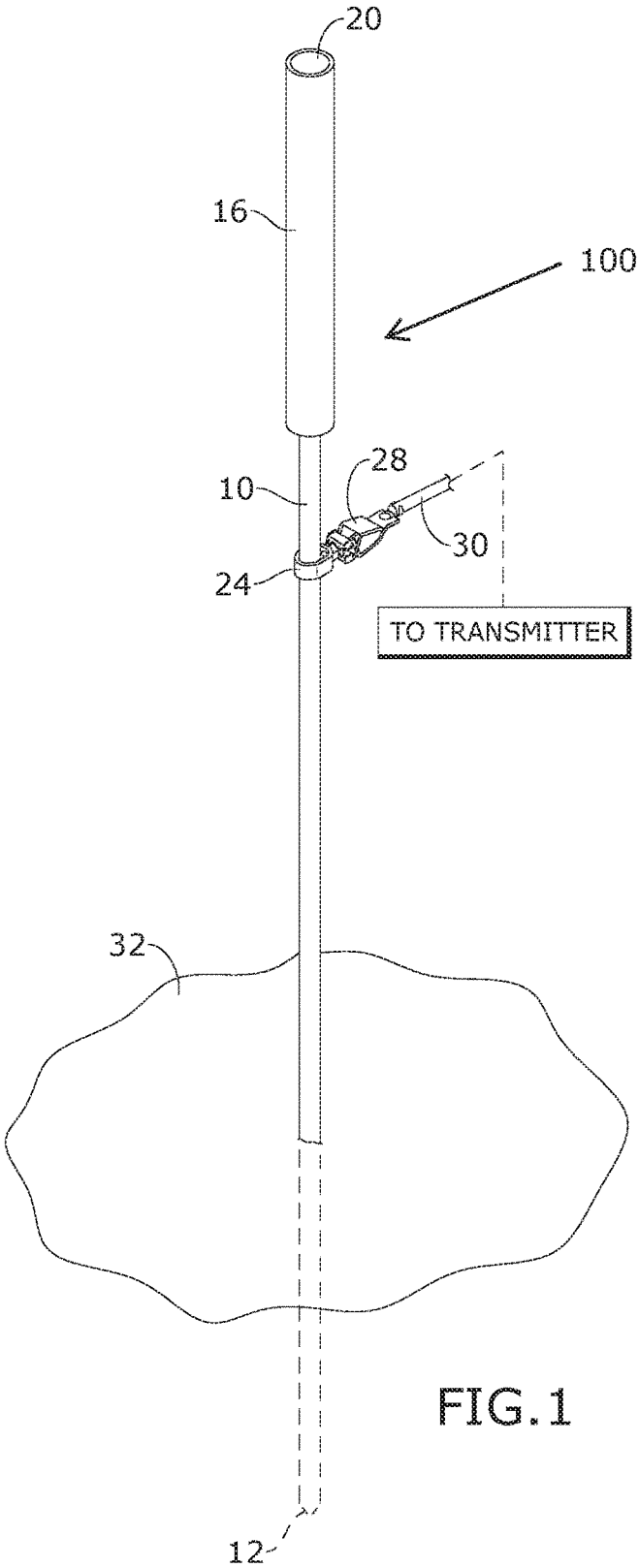
FIG. 1 is a perspective view of an exemplary embodiment of the present invention, shown in use.
Figure 2:
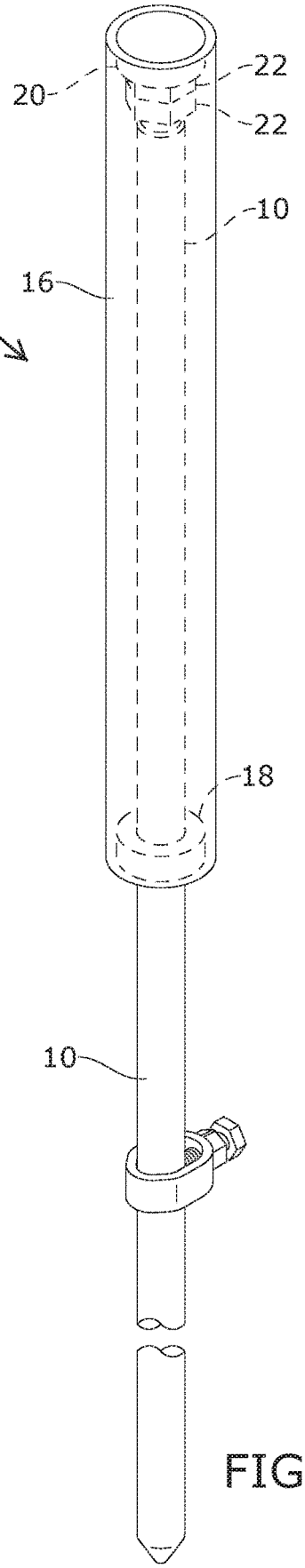
FIG. 2 is a perspective view of an exemplary embodiment of the present invention.
Figure 3:
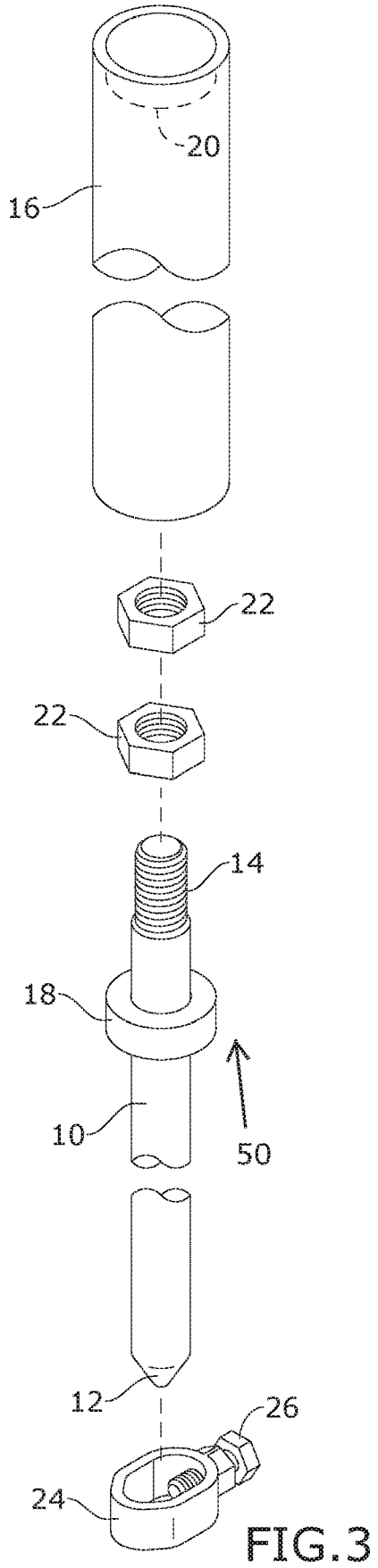
FIG. 3 is an exploded perspective view of an exemplary embodiment of the present invention.
Figure 4:
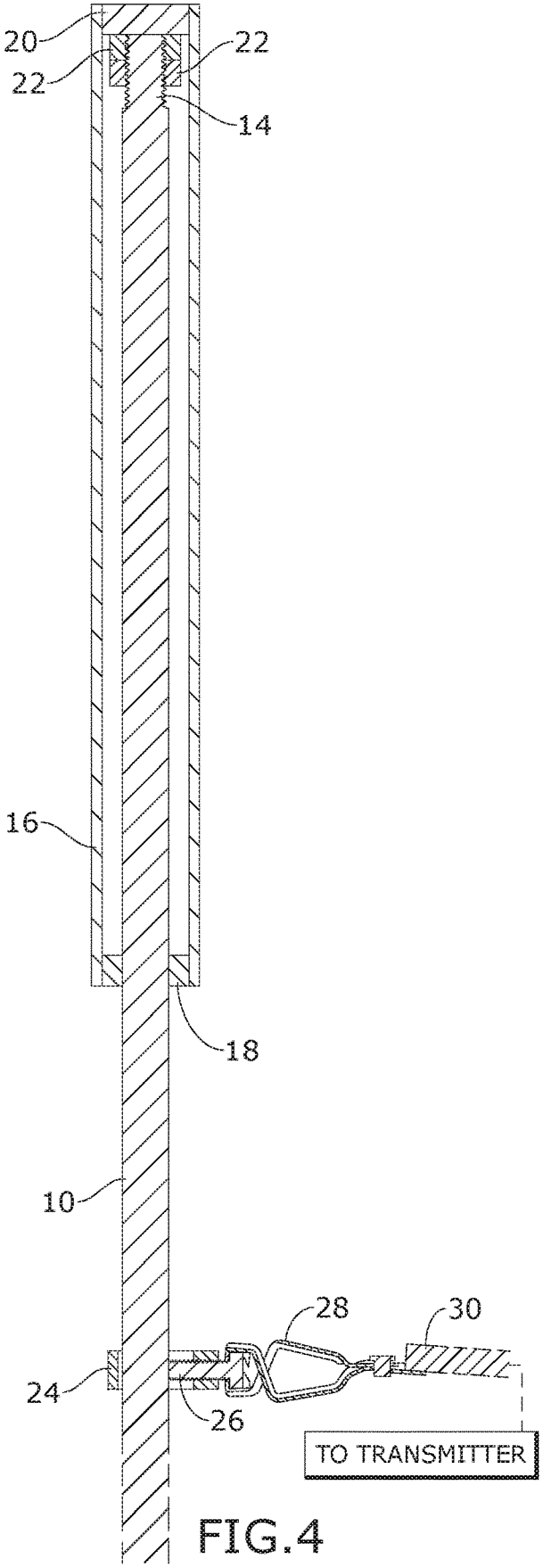
FIG. 4 is a section view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a unitary tool that combines a ground rod to a self-hammering mechanism in a trapped configuration. The ground rod has a length ranging between forty-two and fifty-two inches for facilitating the self-hammering functionality. The ground rod is made from copper-bonded steel for more effectively grounding an electrical connection than the prior art.

Referring now to FIGS. 1 through 6, the present invention may include a unitary tool 100 combining a self-hammering mechanism 50 and a ground rod 10. The ground rod 10 extends from a pointed tip 12 to a proximal end 14. The proximal end 14 couples to one or more stops 22, which effectively create a radial flange or provide an effective increase in the circumference of the ground rod 10 at or near the very end of the proximal end 14. In certain embodiments, proximal end 14 may provide threading for operatively associating with the stops 22 that may be threaded fasteners, such as nuts or the like. The ground rod 10 may be generally cylindrical and have a longitudinal length ranging between forty-two and fifty-two inches. The ground rod 10 may be made of copper-bonded steel.

A hammer sleeve 16 may be dimensioned and adapted to slidably receive the coupling end 14. In certain embodiments, a distal end of the hammer sleeve 16 provides an annular plug 18 dimensioned to receive the proximal end 14 of the ground rod 10, while the proximal end 14 of the hammer sleeve 16 provides a solid pug 20 for engaging the proximal end 14 during the hammering process.

The hammer sleeve 16 is adapted to slide along a proximal portion the length of the ground rod 10 in a controlled manner due to the hole of the annular plug 18. The annular plug 18 and the opposing solid pug 20 and the stops 22 effectively trap the proximal end 14 in the lumen of the hammer sleeve 16 in a trapped configuration.

Figure 6:
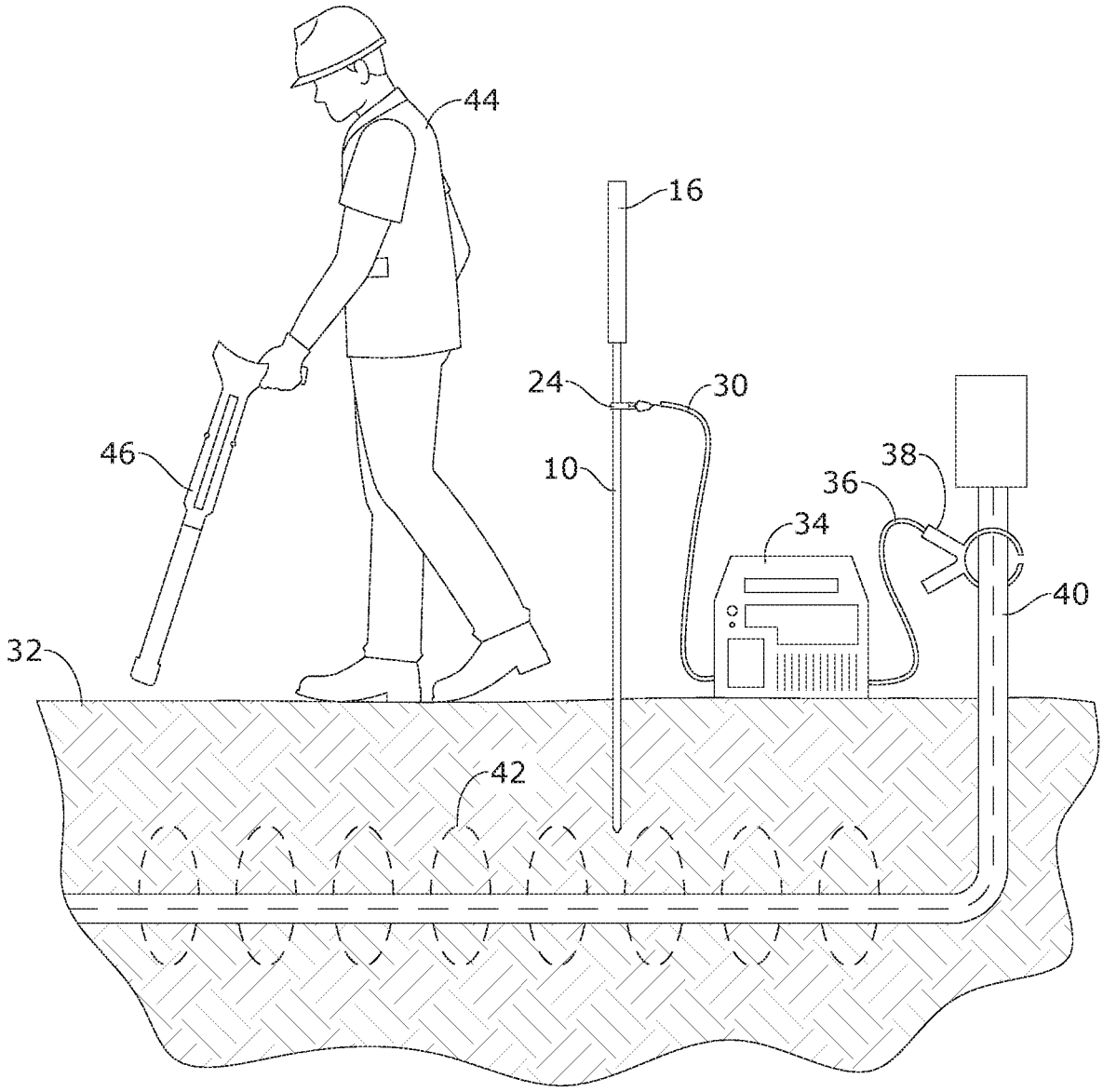
FIG. 6 is a perspective view of an exemplary environment of the present invention shown in use.

A rod clamp 24 may electrically connect the ground rod 10 to a wire clamp 28. The rod clamp 24 may be selectively secured along the length of the ground rod 10 by way of a set screw 26 or equivalent. A ground wire 30 electrically couples the wire clamp 28 to a transmitter 34 which can be electrically coupled to a target line 40 by way of a signal clamp 38 and transmitter wire 36, as illustrated in FIG. 6.

Figure 5A:
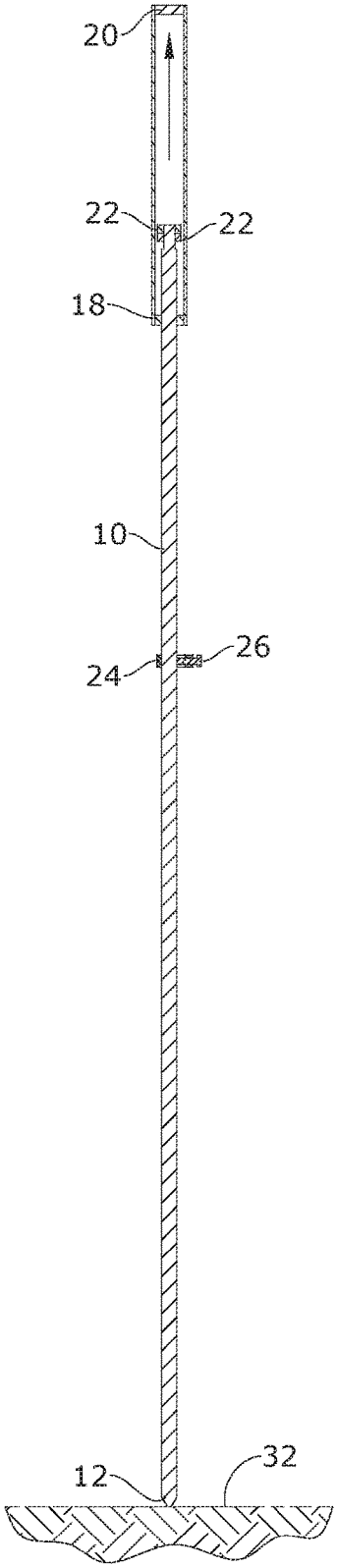
FIG. 5A is a section view of an exemplary embodiment of the present invention, shown in use to illustrate the raising of hammering sleeve 16 as an initial step in the self-hammering process.
Figure 5B:
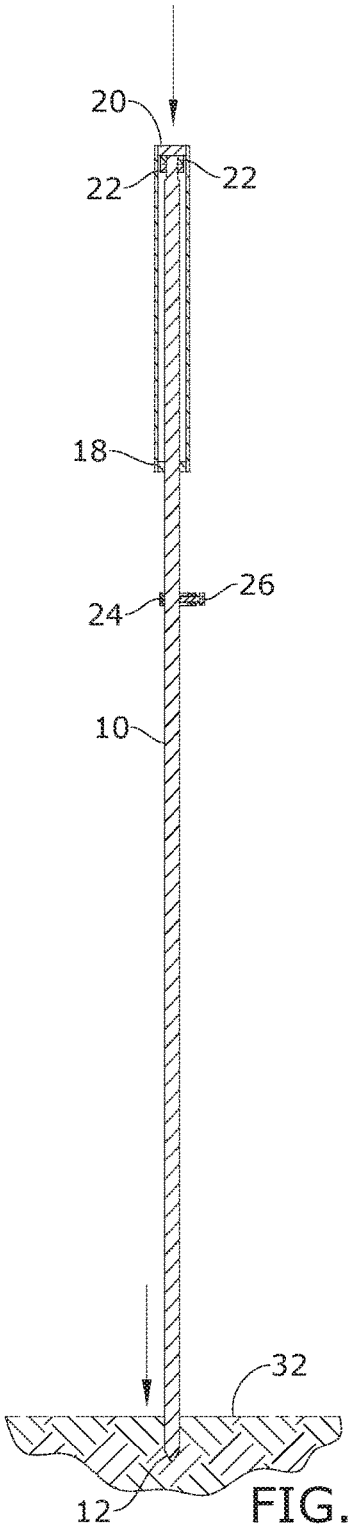
FIG. 5B is a section view of an exemplary embodiment of the present invention, shown in use to illustrate the lowering of sleeve 16 for contacting the proximal end of the ground rod 10 for driving it into the ground 32.
Figure 5C:
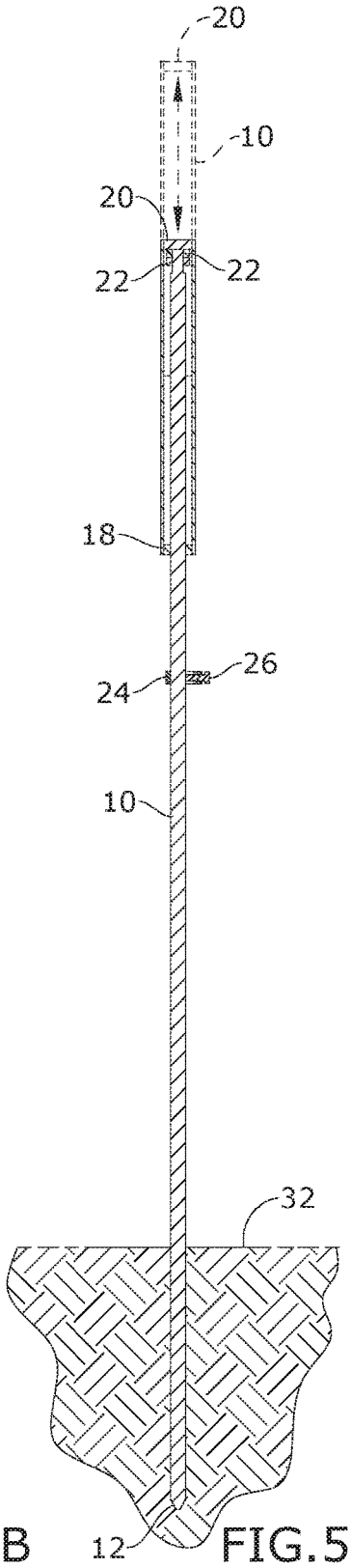
FIG. 5C is a section view of an exemplary embodiment of the present invention, shown in use to illustrate the repeated hammering action of the sleeve 16 to selectively drive the ground rod 10 to a desired depth into the ground 32.

A method of using the present invention may include the following. The unitary tool 100 disclosed above may be provided. Referring to FIGS. 5A through 5C, a user 44 may contact the ground 32 with the pointed tip 12, typically near a suspected underground cable or pipe. Then the user 44 slides the hammer sleeve 16 upward, as illustrated in FIG. 5A, before sliding the hammer sleeve 16 down, as illustrated in FIG. 5B, so that the solid plug 20 drives the ground rod 10 in the ground 32. The user 44 repeatedly slides the hammer sleeve 16 up and down to insert the ground rod 10 into the ground 32 to a desired depth.

Then the user 44 electrically connects the transmitter 34 to the ground rod 10 by way of the clamps 28 and 24. This will electrically ground the transmitter 34, enabling the detection of underground utilities through, in certain embodiments, a receiver 46 and a propagated signal 42.

It should be understood, of course, that the foregoing relates to exemplary embodiments of the invention and that modifications may be made without departing from the spirit and scope of the invention as set forth in the following claims.

What is claimed is:

1. A unitary tool operatively associating a self-hammering mechanism to a ground rod in a trapped configuration, comprising:

the ground rod extending between a proximal portion to a pointed tip;

the self-hammering mechanism comprising:

a hammering sleeve slidably associated with the proximal portion; and an annular plug connected to a distal end of the hammering sleeve preventing the proximal portion from slidably disassociating with the hammering sleeve;

one or more stops mounted to the proximal portion, each stop has a stop diameter exceeding a hole diameter of the annular plug; and threading along the proximal portion; and wherein the one or more stops are screwed to the threading.

2. The unitary tool of claim 1, wherein the ground rod has a longitudinal length between forty-two and fifty-two inches.

3. The unitary tool of claim 1, wherein the ground rod comprises a copper portion.

4. The unitary tool of claim 3, wherein the copper portion comprises copper-bonded steel.

5. The unitary tool of claim 1, further comprising a clamp electrically connected to said copper portion outside of the hammering sleeve.

6. The unitary tool of claim 1, wherein the ground rod and the one or more stops slides relative to the hole diameter of the annular plug, whereby the proximal portion is in the trapped configuration.

7. A unitary tool operatively associating a self-hammering mechanism to a ground rod in a trapped configuration, comprising:

the ground rod extending between a proximal portion to a pointed tip for a longitudinal length between forty-two and fifty-two inches;

the ground rod comprising copper-bonded steel;

the proximal portion having threading;

the self-hammering mechanism comprising:

a hammering sleeve slidably associated with the proximal portion; and an annular plug connected to a distal end of the hammering sleeve, wherein the ground rod is slidable through and relative to an opening in the annular plug;

one or more stops screwed to the threading of the proximal portion, the one or more stops has a stop diameter exceeding a diameter of the opening of the annular plug, trapping the proximal portion is in the trapped configuration by preventing the proximal portion from slidably disassociating with the hammering sleeve; and a clamp electrically connected to said copper-bonded steel outside of the hammering sleeve.

* * * * *